US009140437B2

(12) United States Patent
Brink

(10) Patent No.: US 9,140,437 B2
(45) Date of Patent: Sep. 22, 2015

(54) LED LIGHTBULB

(71) Applicant: U.S. Speedo, Inc., Flint, MI (US)

(72) Inventor: Harry Brink, Flint, MI (US)

(73) Assignee: U.S. SPEEDO, INC., Flint, MI (US)

( * ) Notice: Subject to any disclaimer, the term of this patent is extended or adjusted under 35 U.S.C. 154(b) by 79 days.

(21) Appl. No.: 14/060,955

(22) Filed: Oct. 23, 2013

(65) Prior Publication Data

US 2015/0092426 A1 Apr. 2, 2015

Related U.S. Application Data

(63) Continuation-in-part of application No. 14/041,315, filed on Sep. 30, 2013.

(51) Int. Cl.

| | |
|---|---|
| ***F21V 23/00*** | (2015.01) |
| ***F21K 99/00*** | (2010.01) |
| ***F21S 8/10*** | (2006.01) |
| *F21Y 101/02* | (2006.01) |
| *F21Y 111/00* | (2006.01) |

(52) U.S. Cl.

CPC ..... *F21V 23/00* (2013.01); *F21K 9/00* (2013.01);*F21K 9/13* (2013.01); *F21S 48/212* (2013.01); *F21Y 2101/02* (2013.01); *F21Y 2111/001* (2013.01)

(58) Field of Classification Search

USPC ..... 362/249.02, 249.06, 254

See application file for complete search history.

(56) References Cited

U.S. PATENT DOCUMENTS

| | | | | |
|---|---|---|---|---|
| 2009/0135595 | A1* | 5/2009 | Chen | 362/235 |
| 2010/0284188 | A1* | 11/2010 | Chen et al. | 362/249.02 |
| 2011/0075431 | A1* | 3/2011 | Wu | 362/373 |
| 2011/0248631 | A1* | 10/2011 | Chuang | 315/32 |
| 2011/0273072 | A1* | 11/2011 | Oki | 313/46 |
| 2012/0287636 | A1* | 11/2012 | Chen | 362/249.02 |

* cited by examiner

*Primary Examiner* — Laura Tso

(74) *Attorney, Agent, or Firm* — Raggio & Dinnin, P.C.

(57) ABSTRACT

An LED light bulb system that has a socket base and a contactor arranged in the socket base. The light bulb system also has a support circuit board secured to the socket base and a plurality of circuit boards connected to the support circuit board in a vertical direction. The light bulb also uses at least one resistor on each of the plurality of circuit boards to operate the LED.

16 Claims, 22 Drawing Sheets

LED LIGHTBULB

This application is a continuation in part application of pending U.S. application Ser. No. 14/041,315—Filed on Sep. 30, 2013

BACKGROUND OF THE INVENTION

1. Field of the Invention

The invention generally relates to light bulbs and more particularly relates to a LED wedge light bulb system.

2. Description of Related Art

Light bulbs, such as T-10 style light bulbs and LED's, have been well known in the art and available in the market place for quite sometime. Generally, in the prior art, a wedge bulb is only the light bulb portion of a lighting system. Some prior art LED light bulbs require a base to mount to a circuit board in order to emit light in a predetermined direction and color. Generally, these prior art LED bulb bases are a twist in style base with metal connectors, which carry the current to the light bulb for use in lighting the LED style light bulb. It should be noted that these prior art T-10 wedge light bulbs generally have low power consumption and ultra long life and may be used in any known lighting application, but generally are used for replacement of turn signal lights, corner lights, parking lights, side marker lights, tail lights, backup lights, etc., and may be used in the automotive, marine or aviation vehicle industries. These prior art LED light bulbs may be compatible to numerous socket and bulb models, such as but not limited to T-10, 194, W5W, 147, 152, etc. It should be noted that generally these wedge style prior art LED light bulbs use SMD panels or surface mounted devices to form the light bulbs. These surface mounted devices (SMD) generally have pixels that consist of red, green and blue diodes mounted into a single package, which is then mounted on a driver PC board. It should be noted that the individual diodes in some prior art LED bulbs are smaller than a pin head and are set very close together. It should also be noted that conventional or discrete LED's may also be used in prior art LED bulb technologies.

Therefore, there is a need in the art for an improved LED SMD light bulb system. There also is a need in the art for an LED SMD light bulb system that is easier to connect to the lighting system. There also is a need in the art for a more reliable LED SMD style light bulb that may assure proper alignment between metal contactors and the circuit boards, components, or receptacles carrying the LEDs. There also is a need in the art for a more robust LED SMD light bulb system that may not vibrate out of a wedge base during use in a vehicle. There also is a need in the art for a one piece design or system for a LED light bulb and base integrated with one another.

SUMMARY OF THE INVENTION

One object of the present invention may be to provide an improved LED light bulb system.

Another object of the present invention may be to provide an improved LED SMD light bulb that is integrated with a socket base.

Still another object of the present invention may be to provide an LED light bulb system that removes and/or reduces connection issues between a light bulb and the base into which the light bulb is arranged.

Still another object of the present invention may be to provide an LED light bulb system that ensures the metal contacts are aligned correctly and touching to ensure maximum efficient operability of the LED light bulb.

Still another object of the present invention may be to provide an LED light bulb system that may not vibrate out of a wedge base thus allowing for a more complete and robust LED light bulb.

Still another object of the present invention may be to provide an LED light bulb system that creates a novel one piece design between a light bulb and a socket base, thus creating a more robust and efficient LED light bulb for use in various applications.

Still another object of the present invention may be to provide an LED light bulb system that reduces the cost and man hours necessary to replace and visually verify the light bulbs are working by creating a combination socket base and light bulb into one integral unit.

Another object of the present invention may be to provide an LED SMD light bulb system that is capable of being used as replacements for turn signal lights, corner lights, parking lights, side marker lights, tail lights, backup lights, and any other light bulb which currently uses a T-10 bulb in any known vehicle, such as automotive, marine, and aeronautical vehicles.

To achieve the foregoing objects and other advantages, a light bulb for use in numerous lighting applications comprises a socket base and a contactor arranged in the socket base. The light bulb also comprises a support circuit board secured to the socket base and a plurality of circuit boards connected to the support circuit board. The light bulb also comprises at least one resistor mounted on each of the plurality of circuit boards.

One advantage of the present invention may be that it provides a novel and improved LED light bulb.

Still another advantage of the present invention may be that it provides a novel and improved LED SMD light bulb system for use in numerous lighting applications.

Yet another advantage of the present invention may be that it provides an LED light bulb system that has a socket base integral with a light bulb thus reducing any connection issues between the light bulb and its associated base.

Still another advantage of the present invention may be that it provides an LED light bulb system that has metal contactors that are properly aligned and correctly touching at all times between the base and the light bulb thus ensuring the light may work in a more efficient and stable manner.

Yet another advantage of the present invention may be that it provides for an LED light bulb system that is resistant to vibration out of the socket into which the LED light bulb is arranged, thus allowing for more uniform and robust light emission from that of prior art LED light bulbs.

Still another advantage of the present invention may be that it provides for a LED light bulb system that integrates into one design both a base socket and a LED light bulb.

Still another advantage of the present invention may be that it provides for an LED light bulb system that reduces the cost of making the light bulb, replacing the light bulb and ensuring the light bulb is working properly.

Other objects, features and advantages of the present invention may become apparent from the subsequent description and the appended claims, taken in conjunction with the accompanying drawings.

DESCRIPTION OF THE EMBODIMENT(S)

Figure 1:
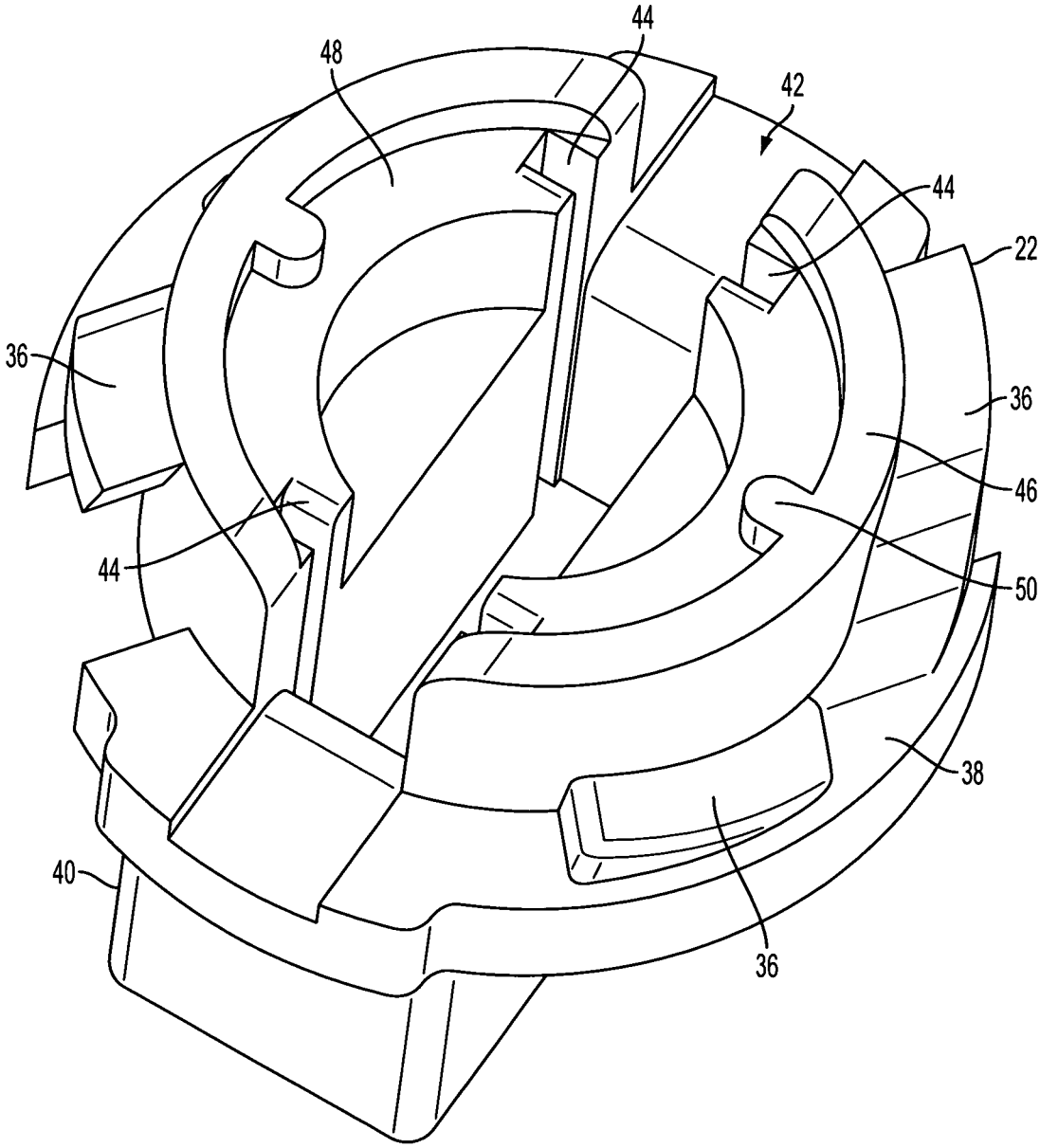
FIG. 1 is a perspective view of a socket base according to the present invention.
Figure 2:
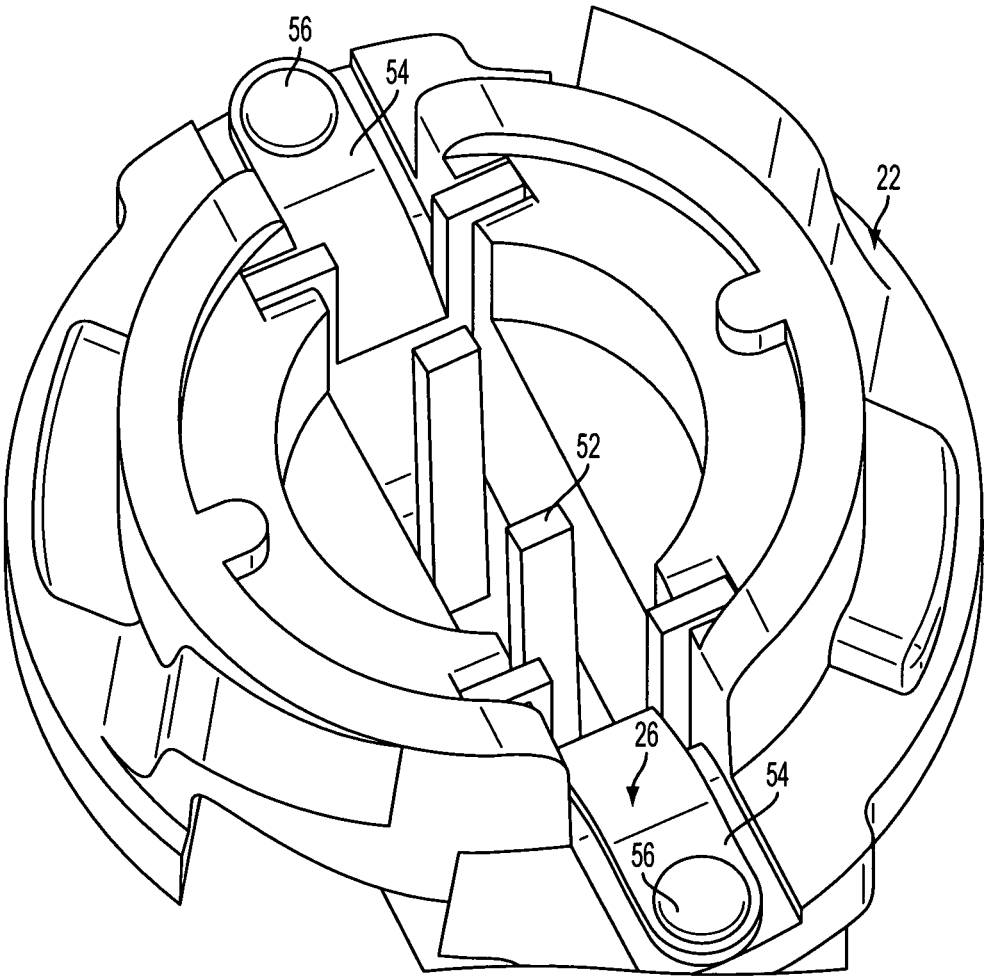
FIG. 2 is a perspective view of a socket base and a contactor according to the present invention.
Figure 3:
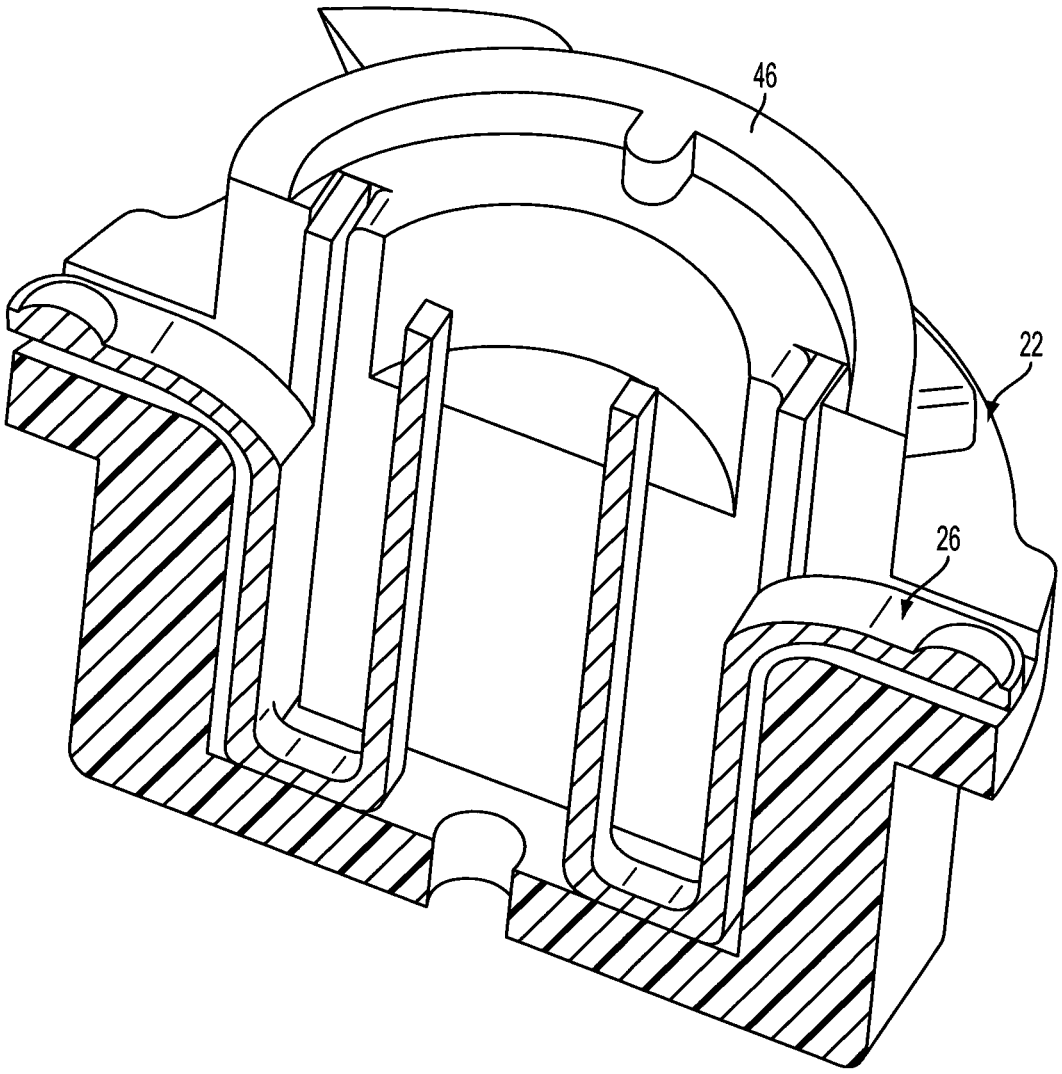
FIG. 3 is a cross sectional view of a socket base and contactor according to the present invention.
Figure 4:
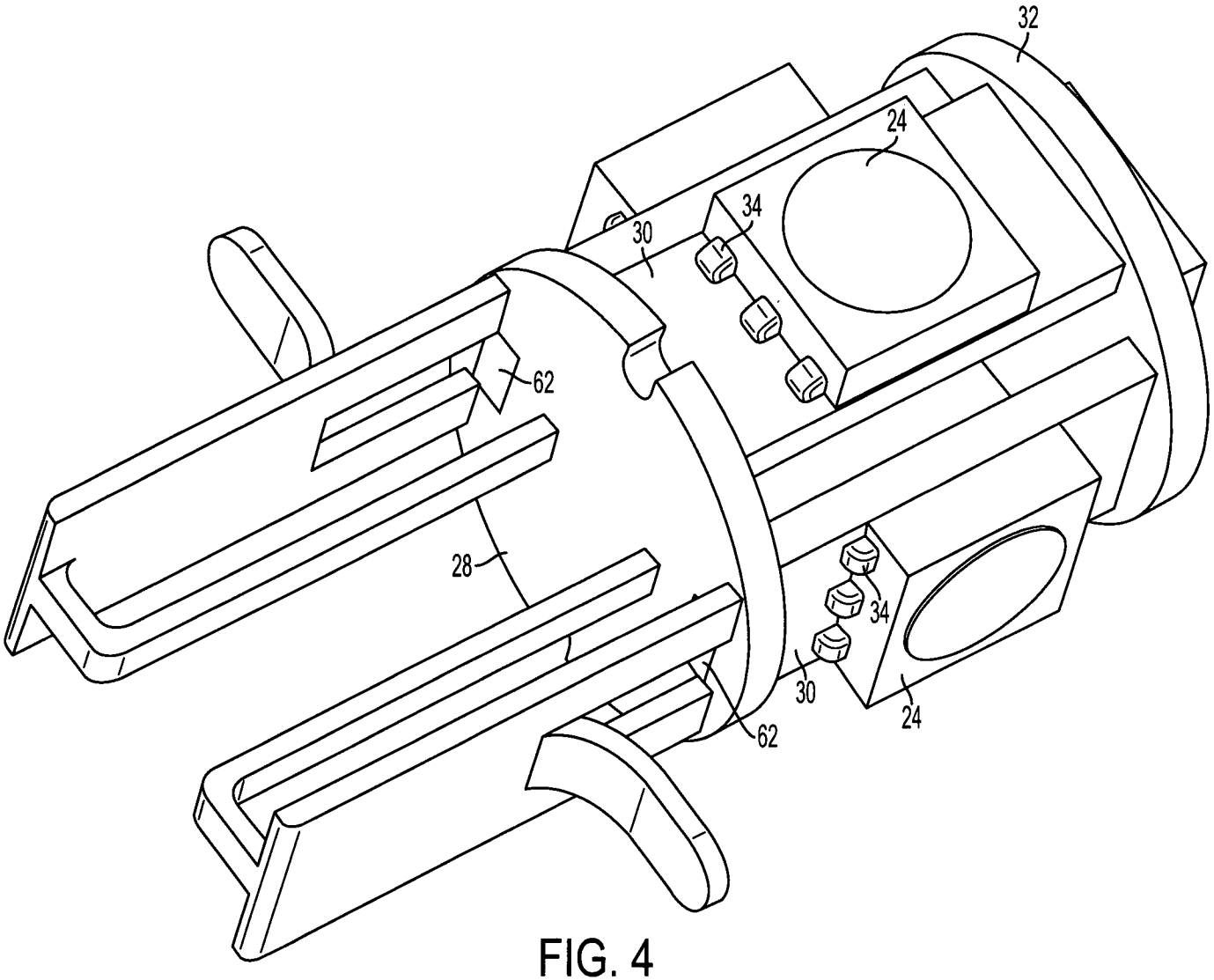
FIG. 4 is a plan view of a contactor and LED light bulb according to the present invention.
Figure 5:
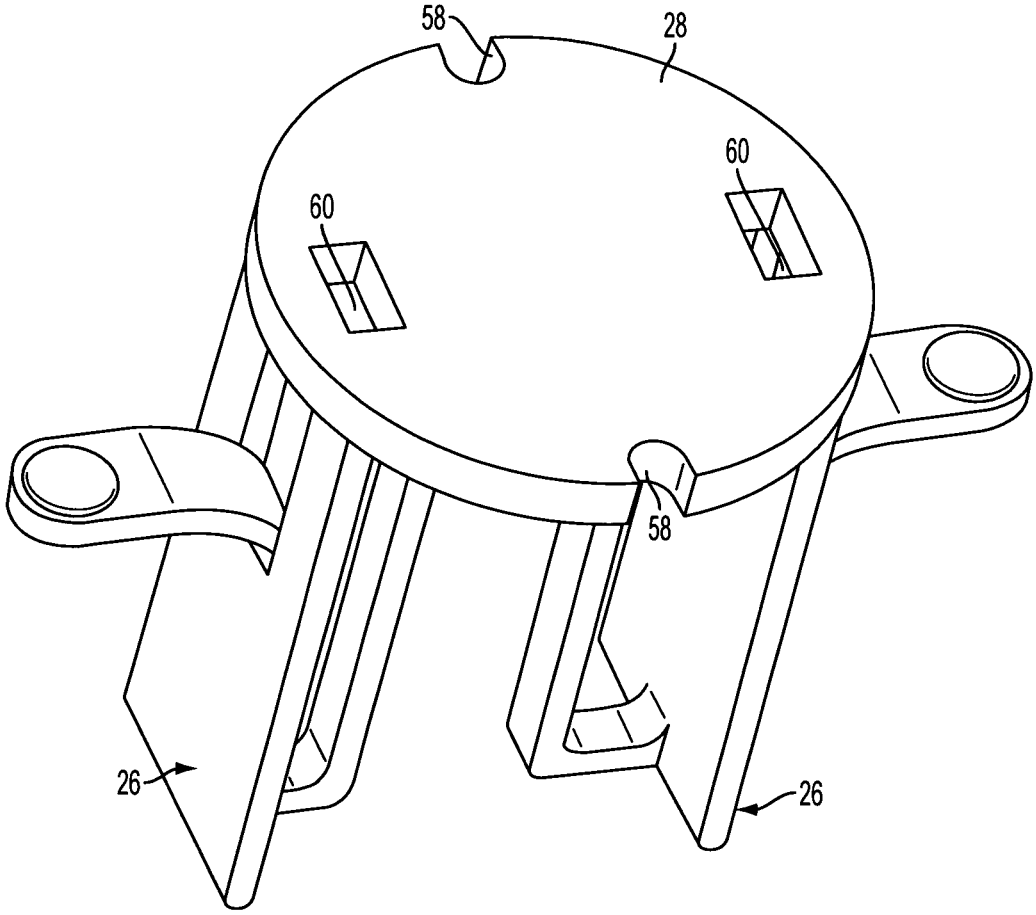
FIG. 5 is a perspective view of a contactor and a support circuit board according to the present invention.
Figure 6:
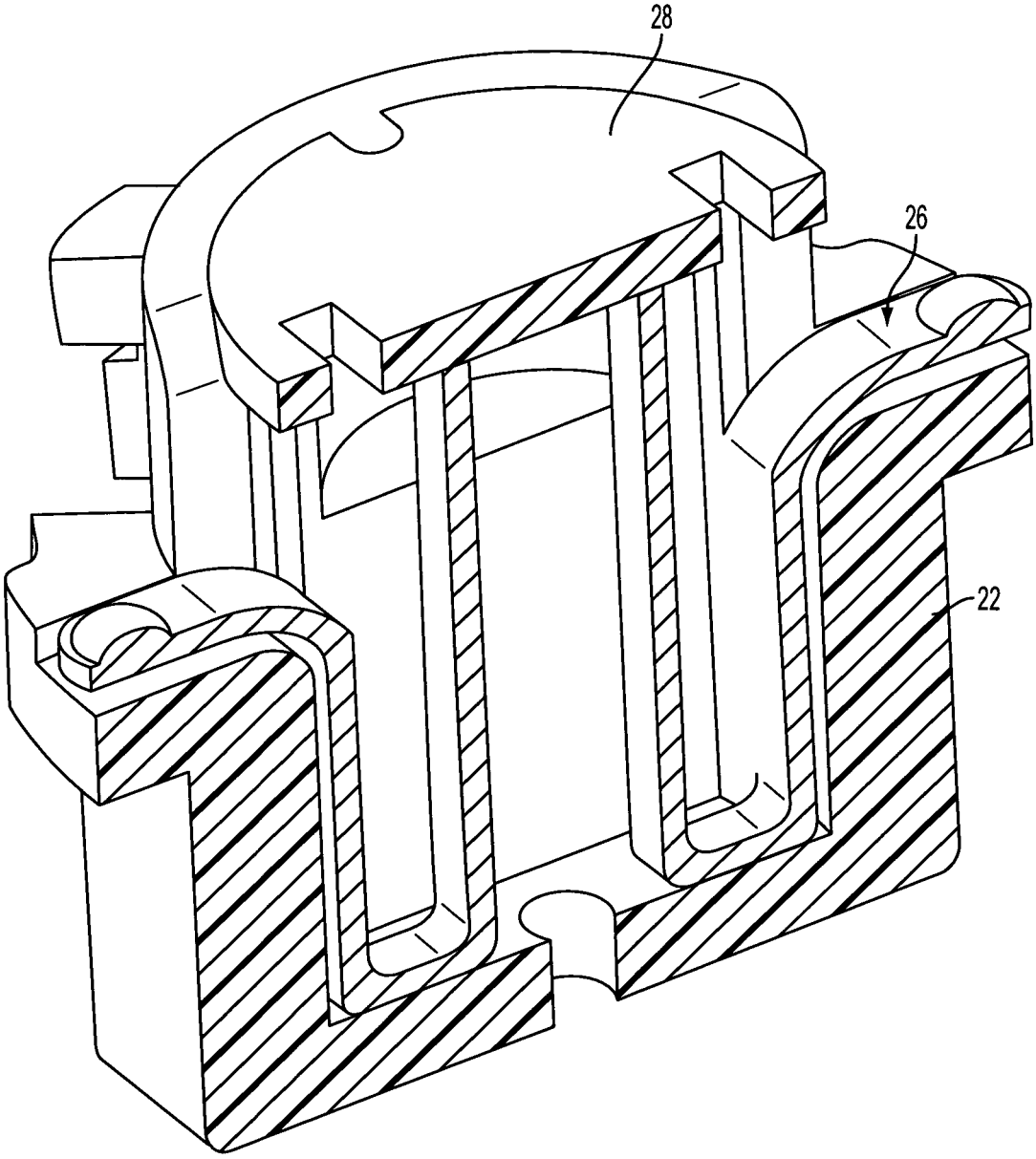
FIG. 6 is a cross sectional view of a socket base, support circuit board and contactor according to the present invention.
Figure 7:
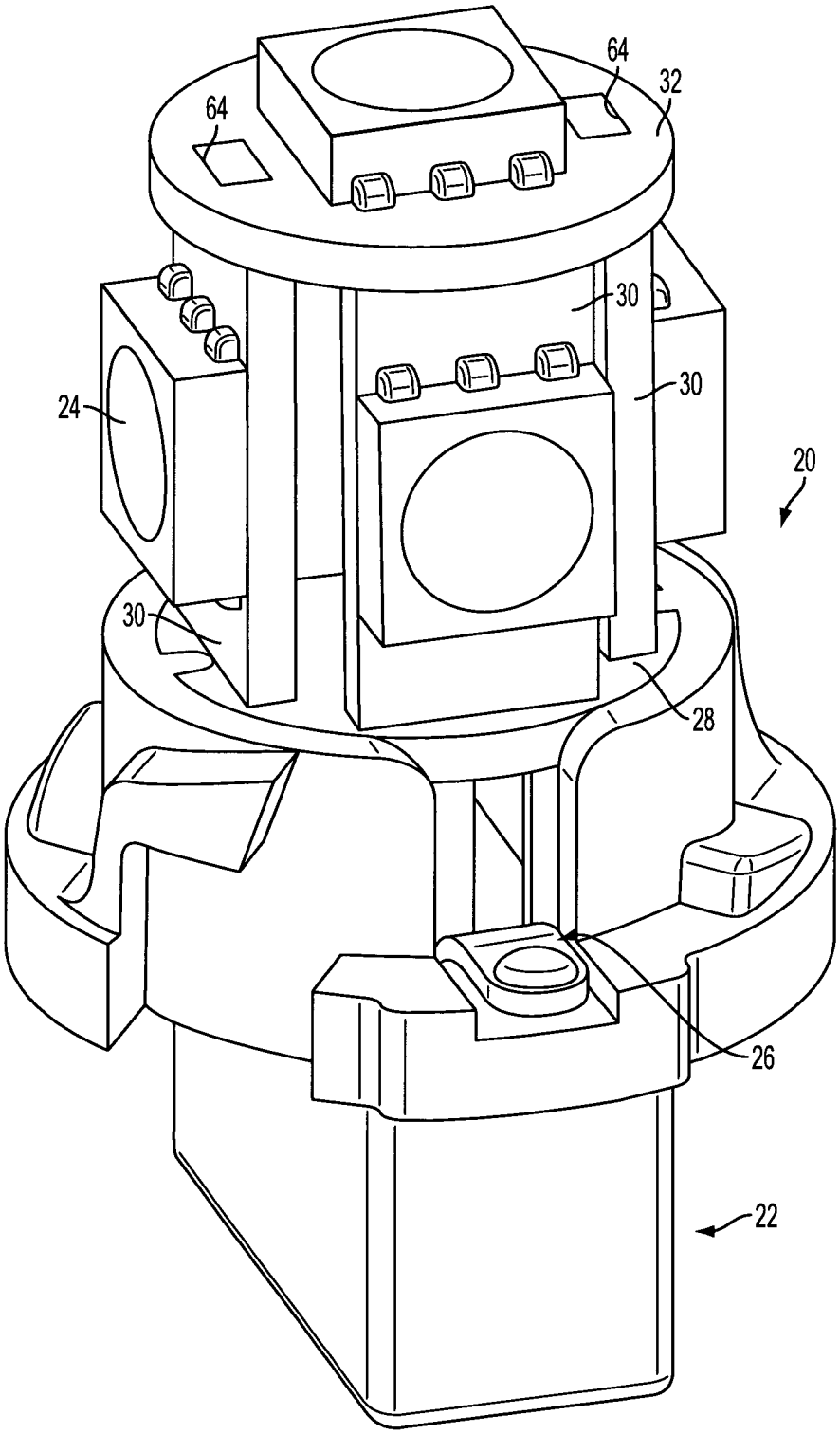
FIG. 7 is a side view of an LED light bulb system according to the present invention.
Figure 8:
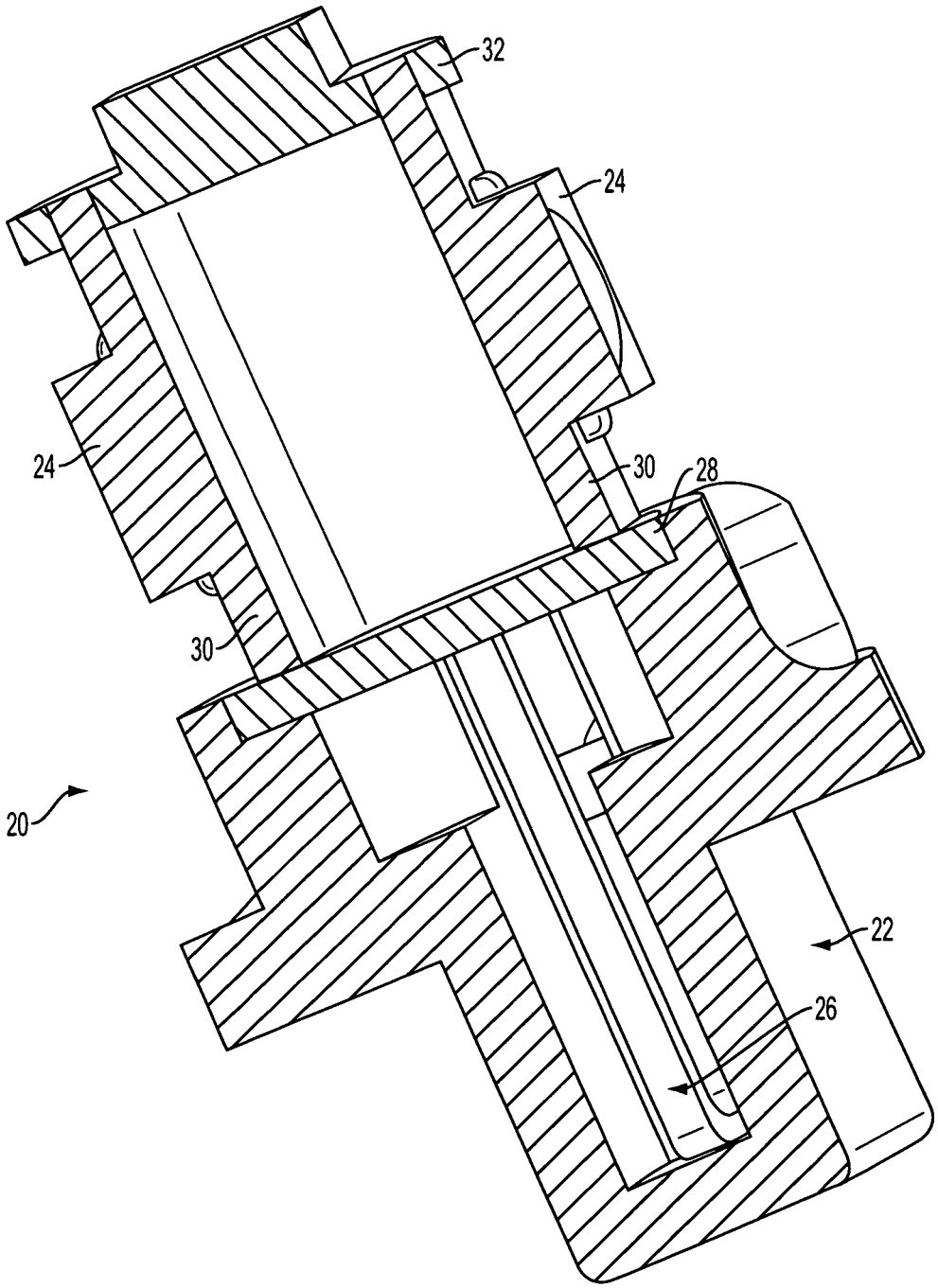
FIG. 8 is a cross sectional view of an LED light bulb system according to the present invention.
Figure 9:
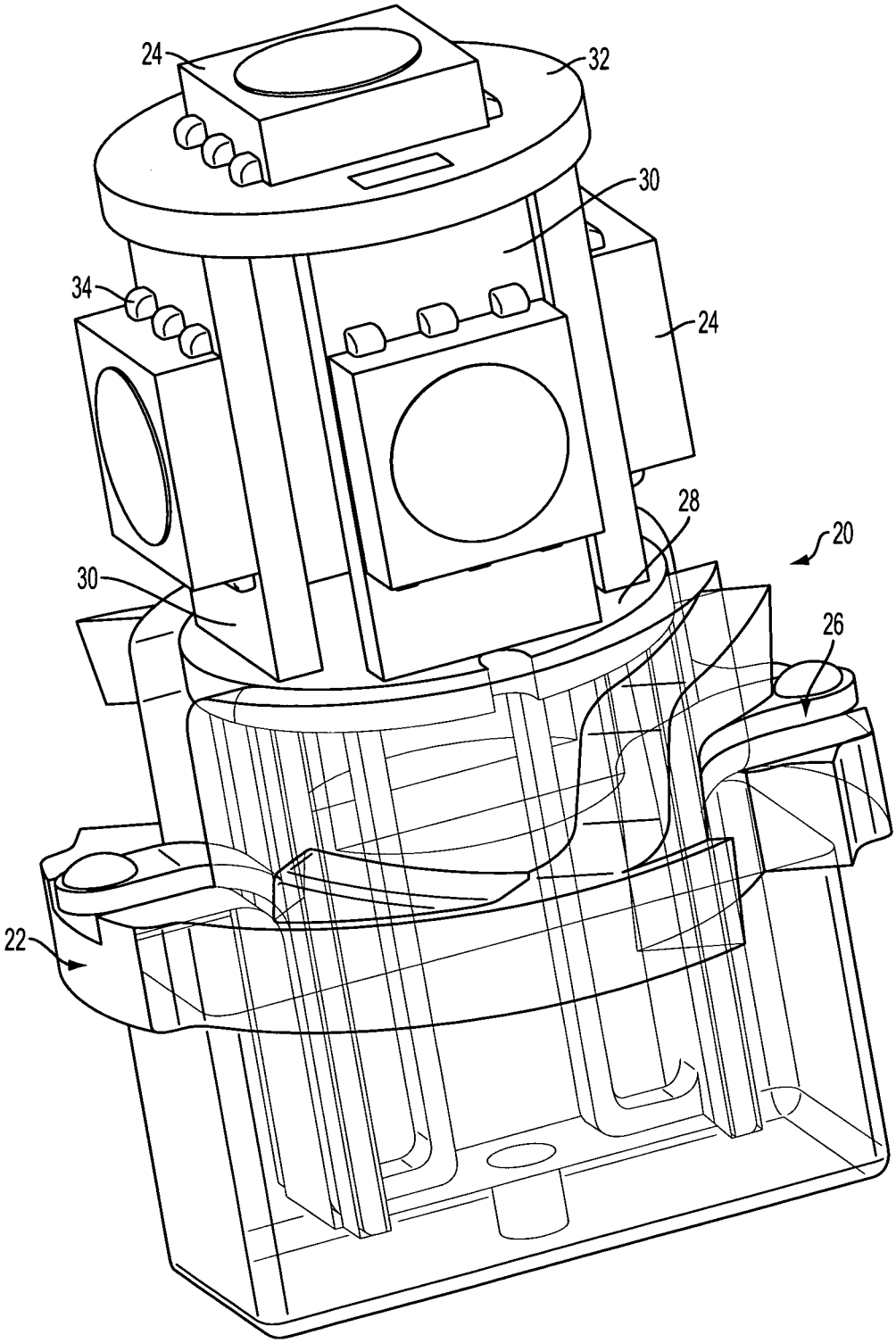
FIG. 9 is a partial cross sectional view of an LED light bulb system according to the present invention.
Figure 10:
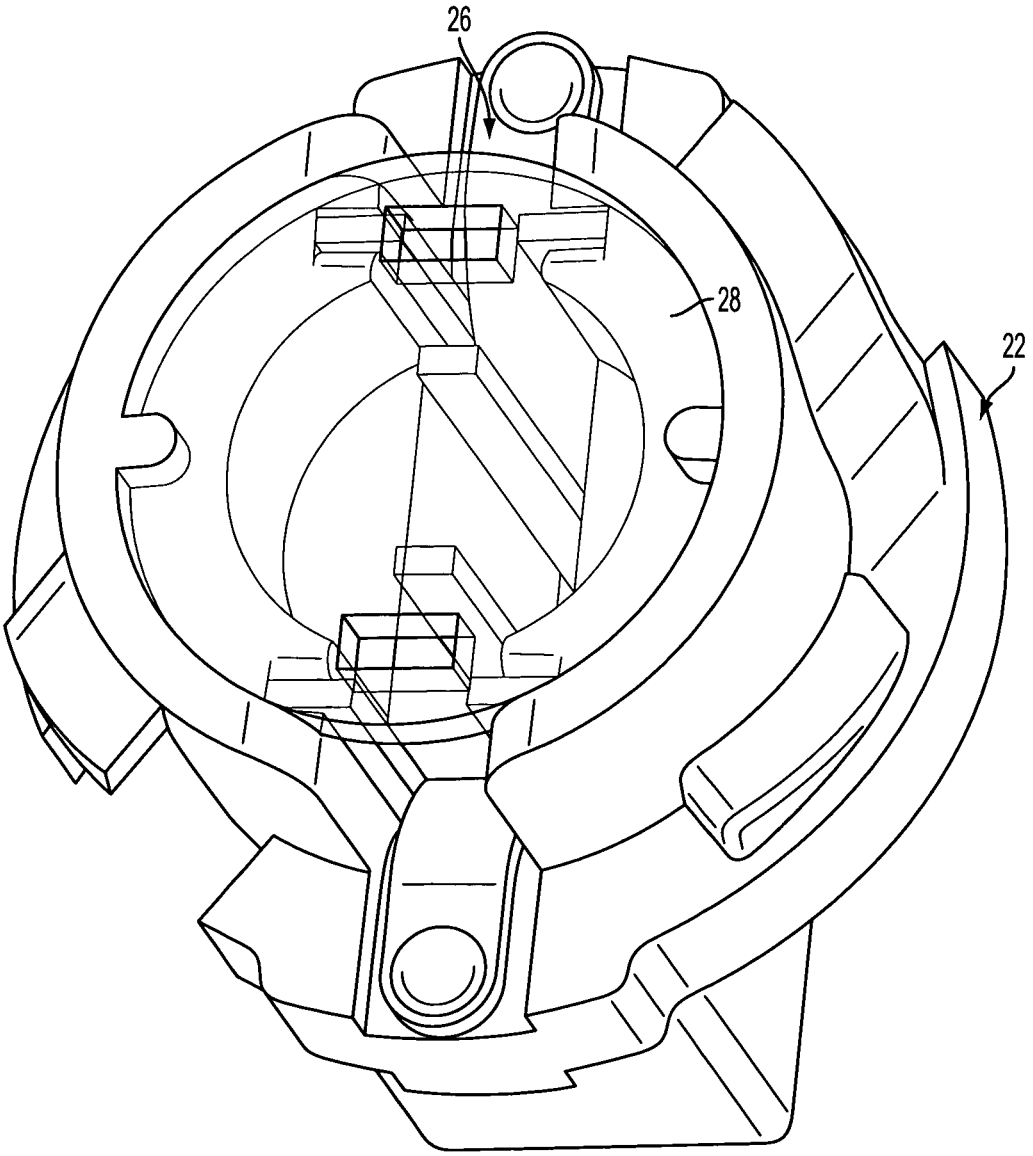
FIG. 10 is a top view of a socket base, support circuit board and contactor according to the present invention.
Figure 11:
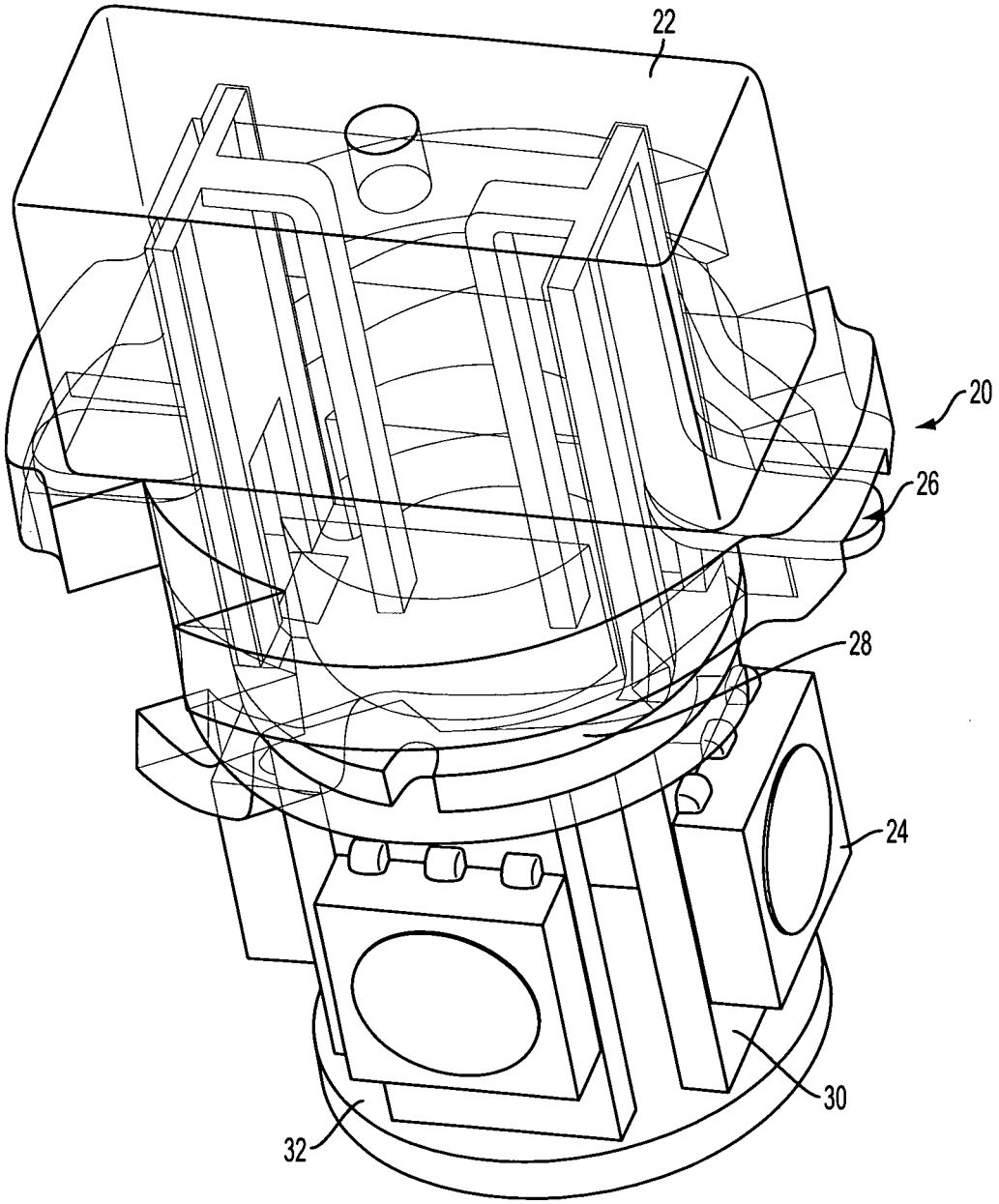
FIG. 11 is a bottom perspective view of an LED light bulb system according to the present invention.
Figure 12:
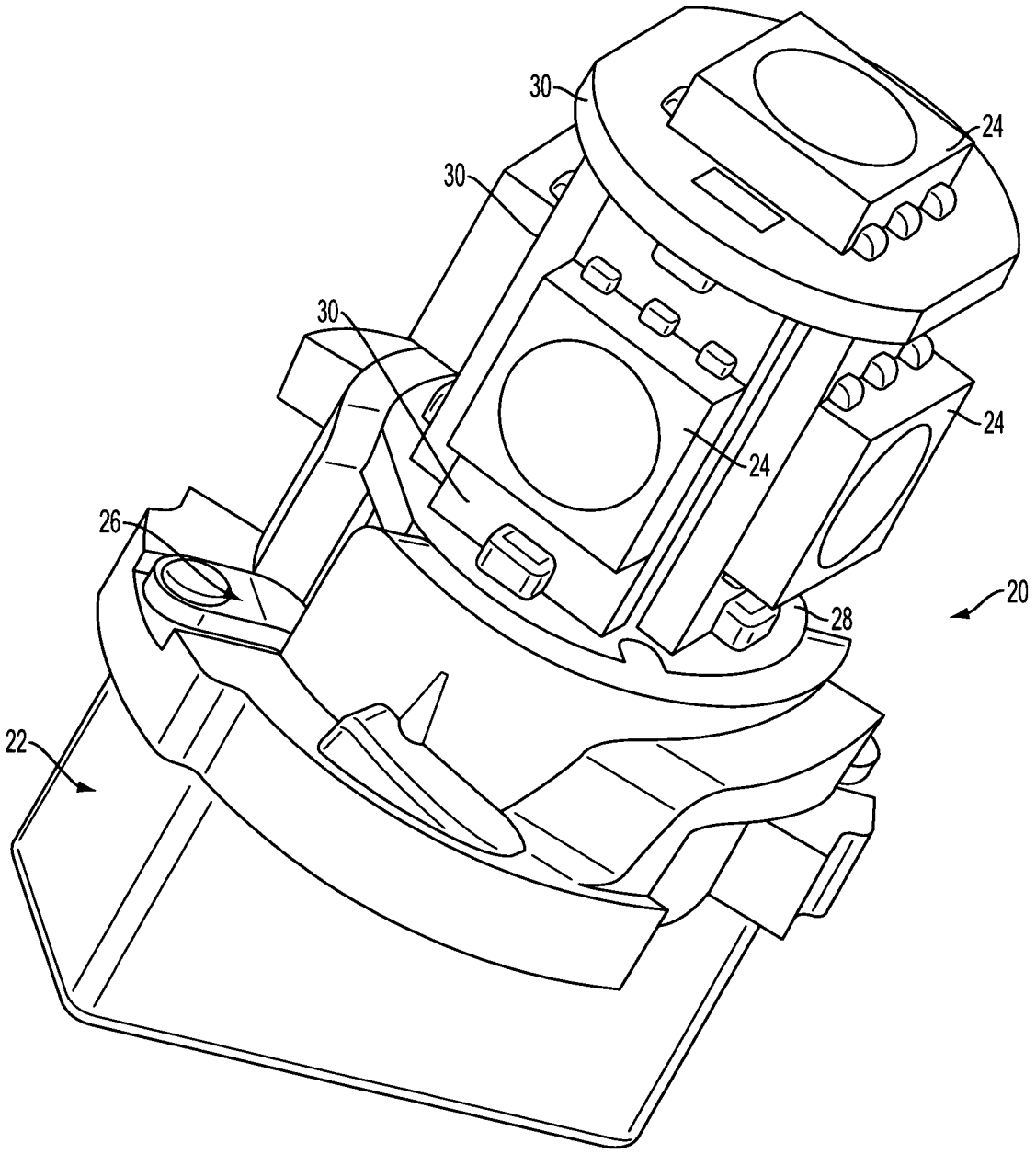
FIG. 12 is a perspective view of an LED light bulb system according to the present invention.
Figure 13:
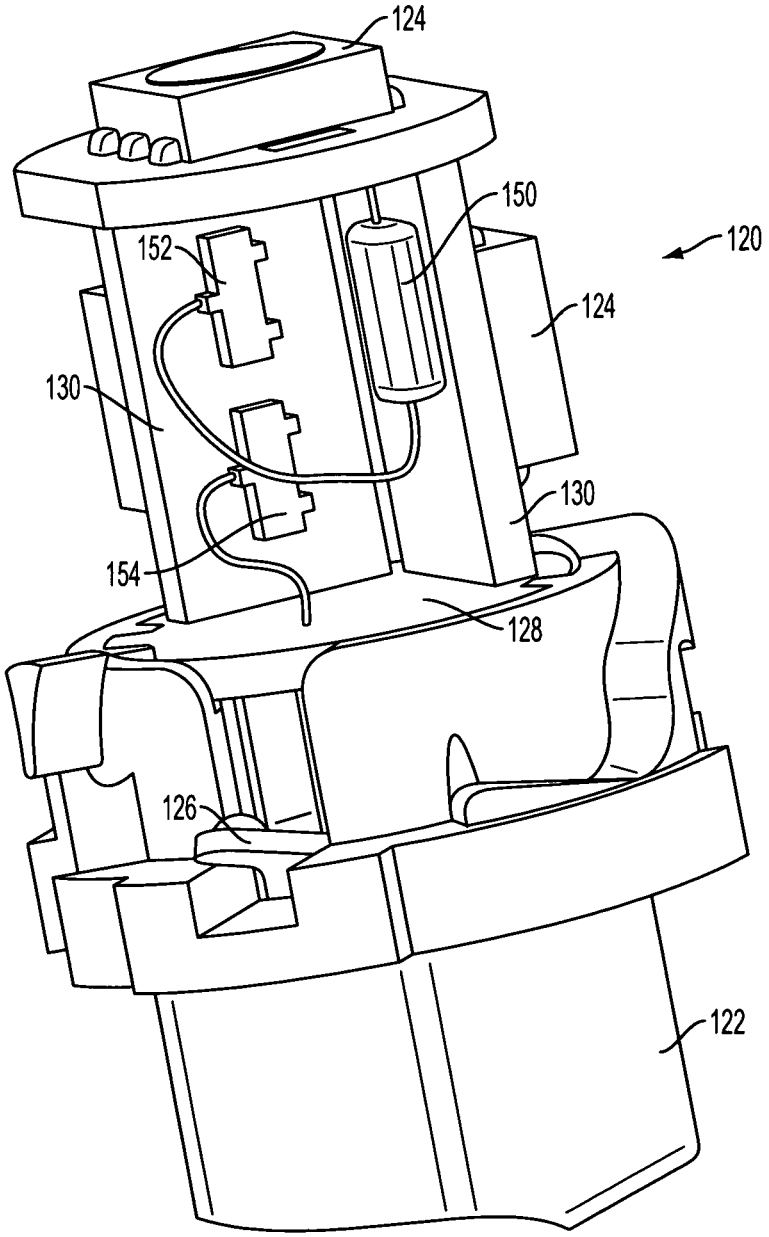
FIG. 13 is a partial perspective view of an LED light bulb system according to an alternate embodiment of the present invention.
Figure 14:
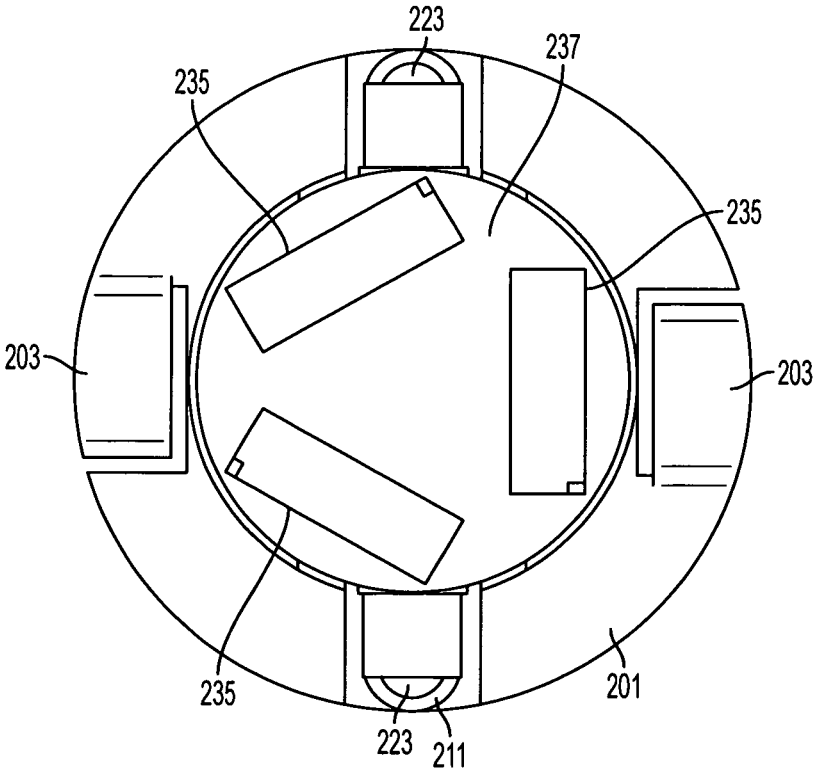
FIG. 14 is a top view of an alternate embodiment of an LED light bulb system according to the present invention.
Figure 15:
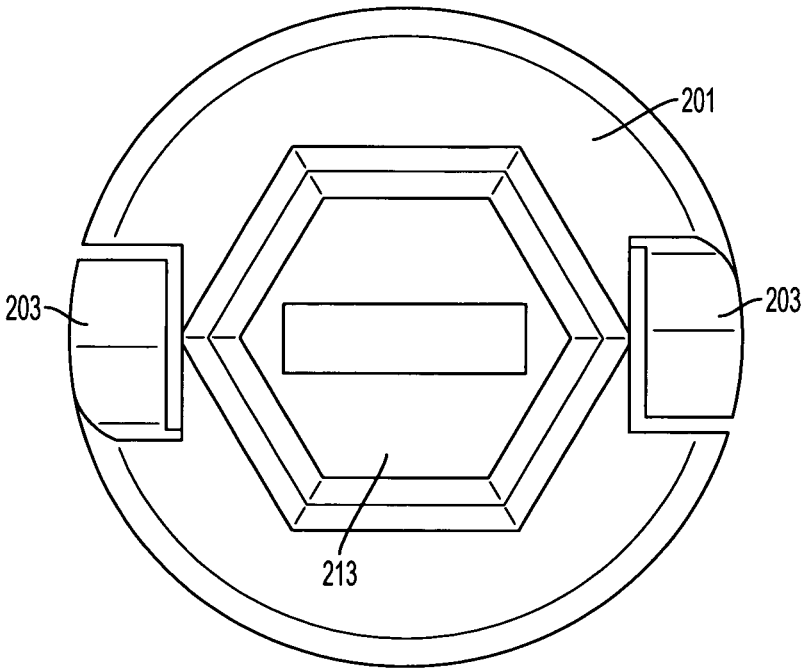
FIG. 15 is a bottom view of an alternate embodiment of an LED light bulb system according to the present invention.
Figure 16:
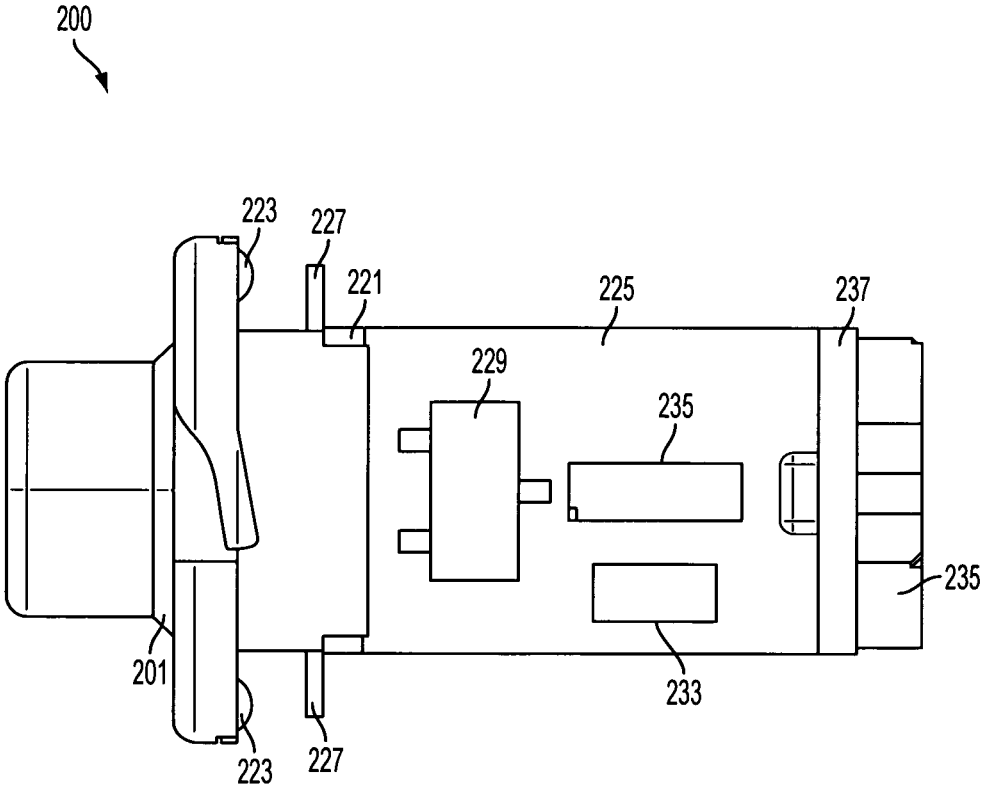
FIG. 16 is a front view of an alternate embodiment of an LED light bulb system according to the present invention.
Figure 17:
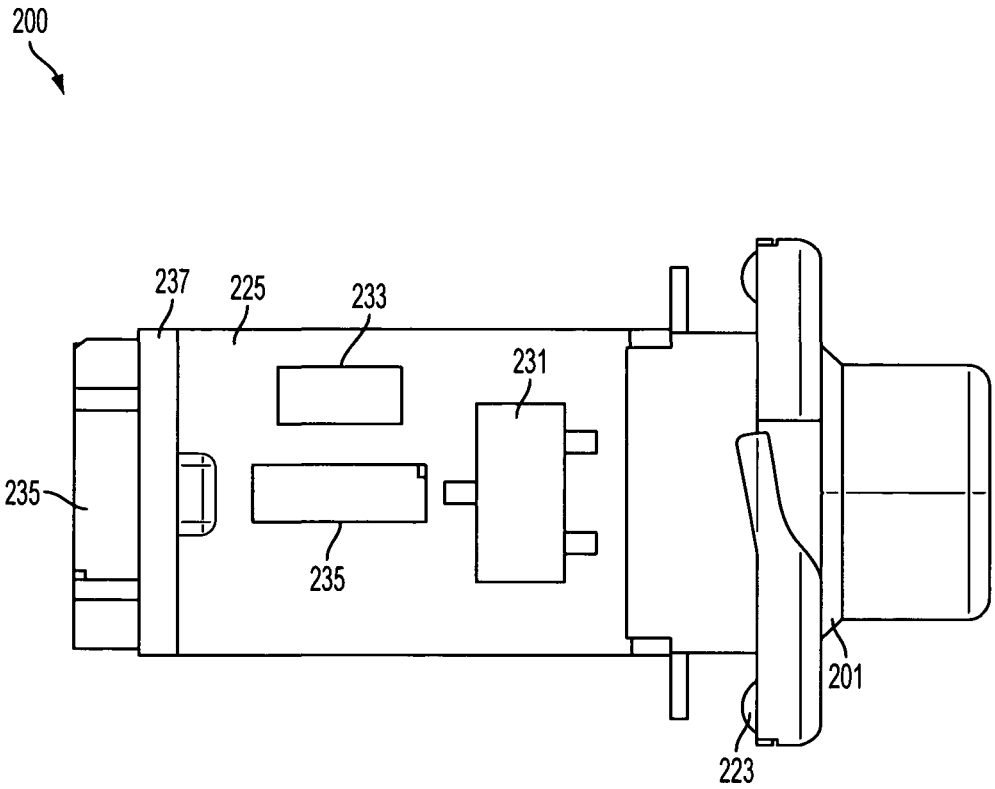
FIG. 17 is a back view of an alternate embodiment of an LED light bulb system according to the present invention.
Figure 18:
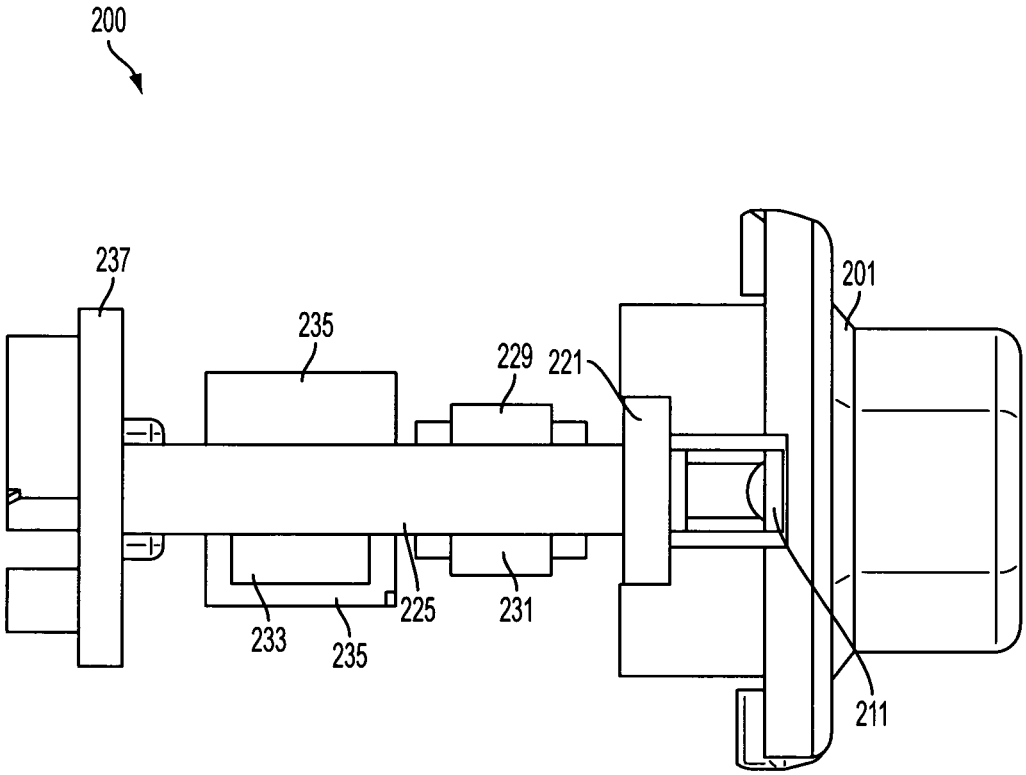
FIG. 18 is a side view of an alternate embodiment of an LED light bulb system according to the present invention.
Figure 19:
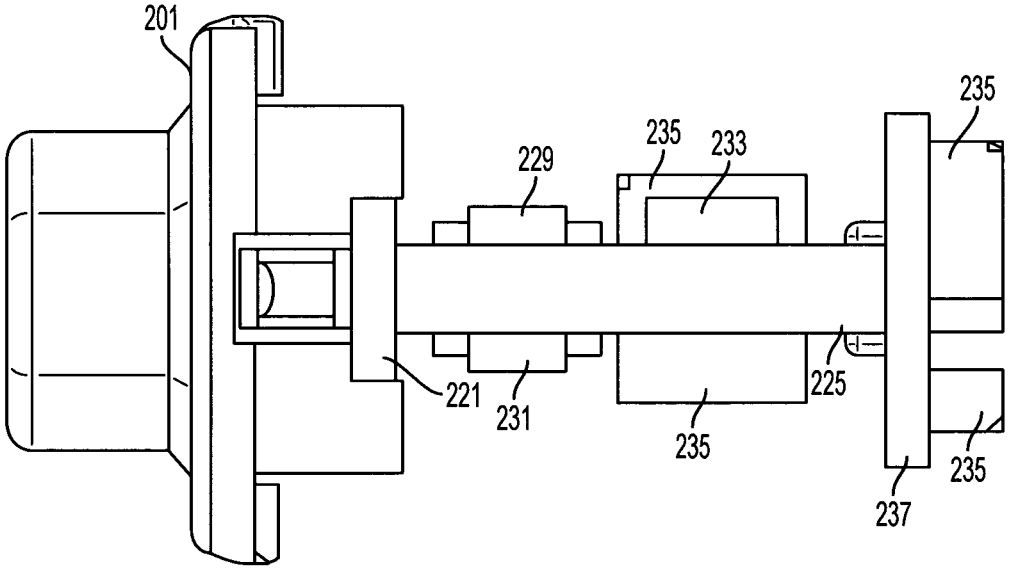
FIG. 19 is a side view of an alternate embodiment of an LED light bulb system according to the present invention.
Figure 20:
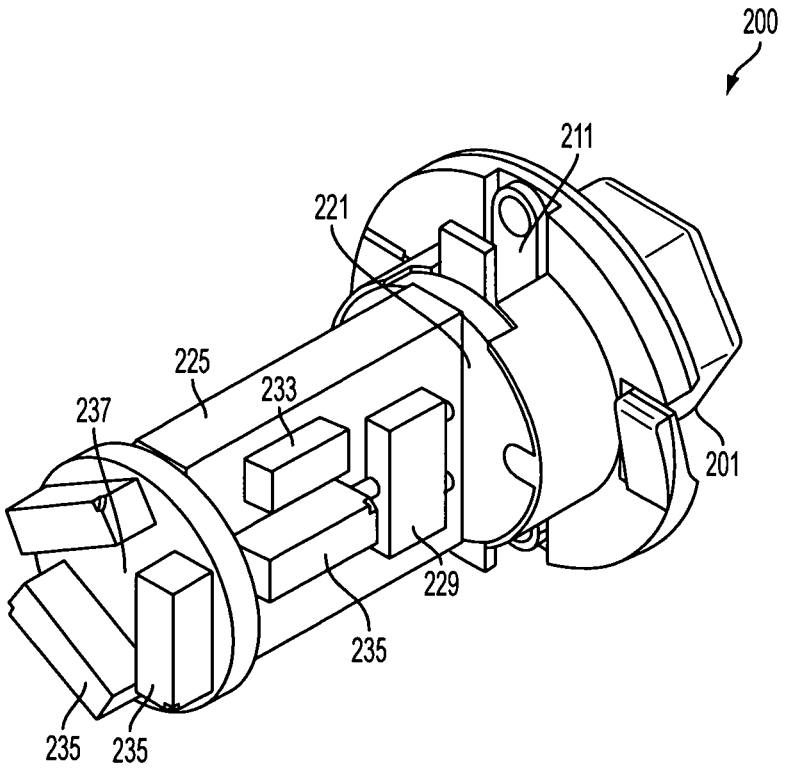
FIG. 20 is a perspective view of an alternate embodiment of an LED light bulb system according to the present invention.
Figure 21:
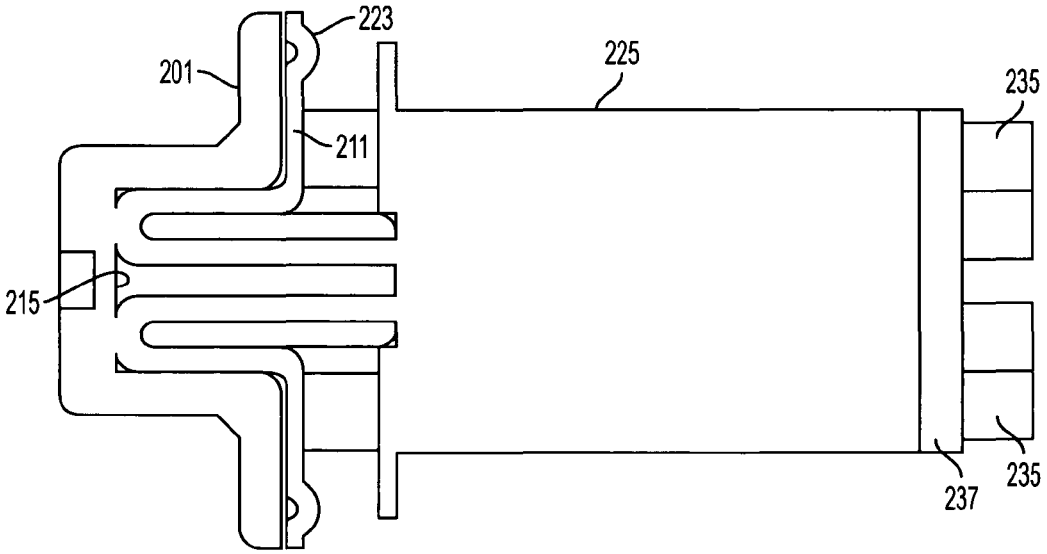
FIG. 21 is a cross sectional view of an alternate embodiment of an LED light bulb system according to the present invention.
Figure 22:
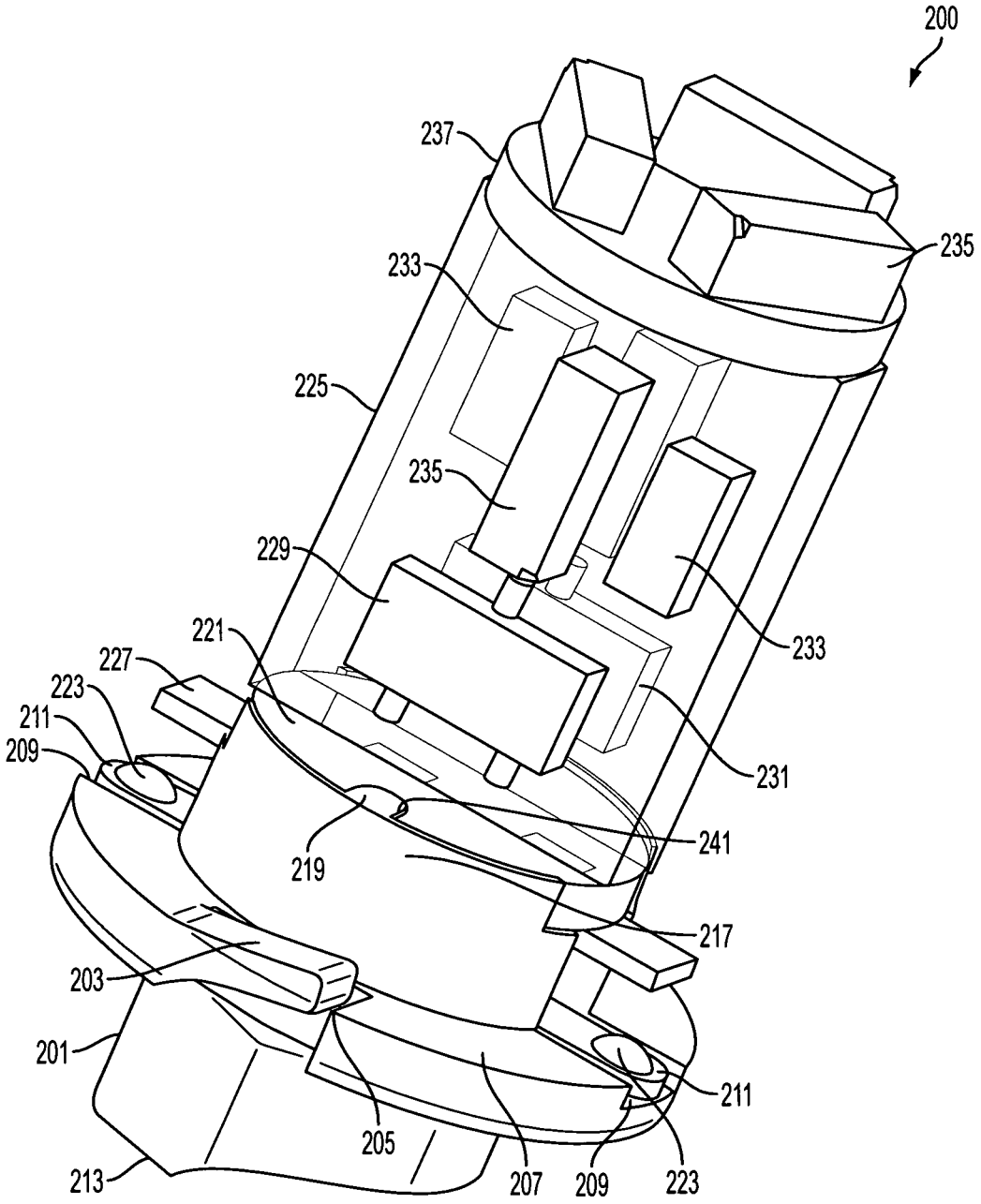
FIG. 22 is a perspective view of an alternate embodiment of an LED light bulb system according to the present invention.

Referring to the drawings, a light emitting diode (LED) light bulb system 20 is disclosed. Light emitting diodes have been known for years for use in light bulbs, flat panel displays and the like. Generally, there are two different types of LED light bulbs, one is a conventional LED light bulb, which uses discrete LED's, the other is a surface mounted device (SMD) panel. The surface mounted device panel generally has an SMD pixel that consists of red, green and blue diodes mounted in a single package, which is then mounted on a driver PC board, receptacle, component, device, or other circuit board. It should be noted that LED light bulbs may be made to replace any known incandescent or CFL light bulbs and in particular are now being used in vehicular applications for both the automotive, marine and aeronautical vehicle industries. Some of these applications create original or replacement bulbs for turn signal lights, corner lights, parking lights, side marker lights, tail lights, back up lights, etc. Generally, many of these bulbs for vehicular applications are referred to as a T-10 type light bulb. Most of the prior art LED replaceable T-10 light bulbs are actually the light bulb itself that are plugged into a socket that is then arranged into a vehicular system to provide the necessary light needed in the vehicle. The present invention is an improved LED light bulb system 20 that integrates a socket base 22 with an LED light bulb to create a more efficient and robust LED SMD light bulb system 20 for use in vehicular applications and in particular, T-10 light bulb designs. However, it should be noted that the design of the socket base 22 integrated with a high out put SMD LED 24 light bulb may be used and converted into any known light bulb in any known industry.

The LED light bulb system 20 of the present invention as shown in FIGS. 1 through 12 generally include a twist in socket that may lock onto a circuit board for a lighting application. The LED light bulb system 20 of the present invention also may include a contactor 26 which may contact with leads on a circuit board to carry or transfer power to the LED's 24 of the light bulb. The LED light bulb system 20 of the present invention may also include a base or support circuit board 28 mounted in contact with the metal contactors 26 to support a plurality of vertically mounted circuit boards 30 that contain LED's 24 thereon. The vertically mounted circuit boards 30 each have at least one LED SMD 24 arranged thereon and are mounted to a top surface of the support circuit board 28 to form generally a square shape for the finished light bulb. It should be noted that each of the LED's 24 on the circuit boards 30 are generally high output SMD LEDs 24. It is also contemplated in the present invention to create and use an additional or top circuit board 32 added to the top of the plurality of circuit boards 30 to allow for an LED 24 to shine vertically away from the socket base 22. It should further be noted that with the present invention each of the circuit boards 30, 32 generally may have at least one resistor 34 arranged thereon in order to reduce the DC current provided in the socket base 22 to the contactor 26 down from its twelve volts to the required power voltage needed to light each LED 24 on the circuit boards 30, 32.

The socket base 22 of the LED light bulb system 20 of the present invention generally is made of a plastic material. However, it should be noted that any other material may be used for the socket base 22 and any other component of the LED light bulb system 20 including but not limited to any known metal, ceramic, composite, plastic, natural material, etc. Generally, the socket base 22 is a twist in socket base 22 that has a plurality of ramps and locking shoulders 36 arranged on a collar 38 of the socket base 20 that may allow for it to mate with and interact with a reciprocal socket or component arranged on a circuit board or any other known device of a vehicle or other component. Generally, the twist in socket base 22 of the present invention may be a locking base that via the ramps and locking shoulders 36 arranged on a collar 28 of the socket base 22 may interact with reciprocal shoulders and locking ramps of the final destination circuit board or component to create a lock fit between the socket base 22 and the component to which the LED light bulb system 20 is arranged. It should be noted that generally the LED light bulb system 20 of the present invention may be locked in place by rotating the socket base 22 in a clock wise direction or vice versa. To undo or remove the LED light bulb system 20, the socket base 20 may be pushed inward and then rotated in a counter clock wise direction or just rotated in a counter clock wise direction to become disengaged from the component or circuit board to which the LED light bulb system 20 is being used. One end of the socket base 22 generally has a rectangular shaped knob 40 that may be used for gripping and rotating the socket base 22 into its appropriate reciprocal. The socket base 22 also may include a generally rectangular shaped groove 42 along a center line or mid point thereof. At least one contactor 26 is arranged within this groove 42. The locking base 22 of the present invention may also include a plurality of locking slots 44 arranged near the end corners of the groove 42 of the socket base 22. These locking slots 44 generally have a square or rectangular like shape and extend vertically down into the socket base 22. In one contemplated embodiment as shown in FIG. 1, a total of four locking slots 44 are arranged near the ends of the groove 42 of the socket base 22. The locking slots 44 generally are arranged across from one another on opposite ends of the groove 42. The locking base 22 also on one end opposite of the knob 40 like end may include a generally circumferential lip 46. This circumferential lip 46 generally is divided into two generally half circle arcs with the groove 42 arranged therebetween. The circumferential lip 46 generally defines a circumferential notch 48 for the end of the socket base 22. The circumferential lip 46 may also include a tab 50 extending radially inward therefrom. Generally, in one contemplated embodiment, two tabs 50 are arranged 180° from one another one on each half of the circumferential lip 46. These tabs 50 may be used to interact with the support circuit board 28 to secure and align the support circuit board 26 to the socket base 22. It should be noted that it is contemplated to have no tabs or more than the two tabs 50 as described above arranged from the lip 46 of the socket base 22.

The LED light bulb system 20 also may include a contactor 26 generally made of a metal material. The contactor 26 may also be made of any known electrically conductive material, such as any known ceramic, composite, plastic, or natural material that is electrically conductive and capable of passing electricity therethrough. Generally, in the LED light bulb system 20 of the present invention a first and second contactor 26 may be arranged within the groove 42 and locking slots 44 of the socket base 22. The contactors 26 may generally have a body and three legs 52 extending from the body of the contactor 26. The contactor 26 may also have an arm 54 extending at a generally 90° or right angle from the body at a predetermined point thereof. The arm 54 of the contactor 26 may engage with an end portion of the groove 42 of the socket base 22. It should be noted that on a top surface of each of the arms 54 of the contactor 26 may generally be a raised bump or mound 56 that may ensure proper contact between the electrical power source and the LED light bulb system 20. One of the legs 52 of the contactor 26 may extend out at a generally right angle from a bottom portion of the body of the contactor 26 and then extend and turn at another generally 90° angle towards the top of the contactor 26 until an end thereof is in a similar plane as the end of the two other legs 52 which extend directly from the body of the contactor 26. Thus, the three legs 52 of the contactor 26 may all be parallel to one another in a predetermined pattern when viewed from above. The ends of the legs 52 of the contactors 26 may engage and contact a support circuit board 28 arranged in the socket base 22 of the present invention. This may allow for power to be passed from the arms 54 of the contactors 26 through the legs 52 of the contactors 26 directly to the support circuit board 28 and then onto the circuit boards 30, 32 holding the LED SMD high output lights 24. It should be noted that it is also contemplated to create one contactor, which generally has a U-shape instead of two separate contactors for the present invention. It is contemplated to use a press fit to secure the contactors 26 within the locking slots 44 and groove 42 of the socket base 22. However, any other connecting means, either mechanical or chemical, may also be used including but not limited to gluing, welding, etc.

The support circuit board 28 of the present invention generally has a disc like shape. The support circuit board 28 may include a first and second notch 58 arranged 180° from one another on an outside surface thereof. In one contemplated embodiment the notch may be in a generally semi circular shape, such that it interacts with and interengages with the semi circular shaped tabs 50 arranged on the lip 46 of the socket base 22. This may ensure that the support circuit board 28 is rotatably fixed, aligned and secured within the socket base 22 at a predetermined position and without the possibility of being vibrated loose. It should be noted that any known securing technique may be used to secure the support circuit board 28 to the socket base 22 such as any known mechanical or chemical fastening technique, such as gluing, press fit, snap lock, etc. Proper replacement of the support circuit board 28 within the socket base 22 may ensure electrical contact is made between the arms 54 of the contactors 26 and the electrical circuit of the support circuit board 28. This may allow power to flow through the support circuit board 28 to the additional circuit boards 30, 32 attached thereto. The support circuit board 28 may have a predetermined diameter and thickness that generally mimics that of the lip 46 of the socket base 22. The circuit boards 28, 30, 32 may be made of any known material, such as silicone, etc. or any other known material used for circuit boards. In one contemplated embodiment, the support circuit board 28 may include at least one orifice 60 arranged through a surface thereof. In one contemplated embodiment, a first and second orifice 60 generally having a rectangular shape and arranged at predetermined locations from one another may be arranged through a surface thereof. The orifices 60 on one contemplated embodiment may be located 180° from one another and may be arranged a predetermined distance from the outer edge of the support circuit board 28. These orifices 60 may be used to receive a tab extending from a circuit board 30 that may be arranged on a top surface of the support circuit board 28. This may allow for a more robust connection between the circuit boards 30 having the LED's 24 arranged thereon and the support circuit board 28 of the LED light bulb system 20 according to the present invention. It should be noted that generally the support circuit board 28 has a circular or disc like shape, however any other shape may be used for the support circuit board 28 depending on the design and environment in which the LED light bulb system 20 may be used. It should further be noted that the notches on the support circuit board 28 and the orifices through the support circuit board 28 may be of any known shape other than those shapes described above and shown in the drawings.

The LED light bulb system 20 also may include a plurality of circuit boards 30 connected and arranged on a top surface of the support circuit board 28 according to the present invention. Generally, in one contemplated embodiment, the plurality of circuit boards 30 includes four circuit boards 30 that generally make a square shape for the LED light bulb portion of the LED light bulb system 20 according to the present invention. The circuit boards 30 may be arranged such that the LED SMD 24 is arranged and facing in an outward direction thus able to shine light in a complete 360° radius from the light bulb system 20. The LED SMD 24 may have any known shape such as but not limited to square, circular, triangular, random, etc. Generally, the four circuit boards 30 may be rectangular in shape however any other shape such as a square, circular, triangular, random, etc., may also be used for the circuit boards 30 according to the present invention. In one contemplated embodiment at least two of the circuit boards 30 may include a tab 62 extending from an end surface thereof, wherein the tabs 62 may interact with the orifices 60 and the support circuit board 28 to provide a more robust connection between the circuit boards 30 and the support circuit board 28. Each of the four circuit board 30 may be in contact with a top surface of a support circuit board 28 and electrically in communication and connected to the support circuit board 28 in order to have power pass from the contactors 26 through the support circuit board 28 into each of the circuit boards 30 and onto each of the SMD LED's 24 of each of the four circuit boards 30 arranged on the top surface of the support circuit board 28. It is also contemplated to have more than one LED 24 mounted on the surface of the four circuit boards 30, such that multiple lights and multiple colors may be transmitted and emitted from the LED's 24 to provide for varying light intensities and colors. It should be noted that each of the LED's 24 are electrically connected and in communication with the circuit boards 30 to ensure there is power necessary to light the LED's 24. It should be noted that generally each of the circuit boards 30 may have at least one resistor 34 and in some cases multiple resistors 34 arranged thereon. These resistors 34 may reduce the DC current from the twelve volts provided to the contactors 26 of the socket base 22, to the required power voltage necessary to light and run each of the LED's 24 arranged on the circuit boards 30 of the LED light bulb system 20. It should further be noted that any other electronic circuitry and soldering necessary to operate the LED's 24 in the appropriate manner for the environment in which the light bulb is used may also be arranged on each of the four circuit boards 30 according to the present invention.

It should also be noted that it is also contemplated to have an additional or fifth or top circuit board 32 connected to or added to the top of the plurality of circuit boards 30 to allow for an LED 24 to shine vertically away from the socket base 22. This may provide light to be emitted in all directions from the system 20. In one contemplated embodiment the additional or fifth circuit board 32 generally may have a disc like or circular shape, such as that of the support circuit board 28. However, it should be noted that any other shaped circuit board may also be used for the firth or top circuit board 32 according to the present invention. This additional top circuit board 32 may have a SMD LED 24 arranged on its outer surface such as those other four circuit boards 30 described above. The fifth or additional circuit board 32 may also include at least one orifice 64 through a surface thereof and in one contemplated embodiment a first and second orifice 64 arranged in a manner similar to the orifices 60 arranged through the support circuit board 28. Generally, the orifices 64 of the top circuit board 32 may be arranged offset 90° from the orifices 60 through the support circuit board 28 and receive a tab 62 from the end of at least two of the circuit boards 30 arranged on the support circuit board 28, thus increasing the rigidity and robustness of the LED light bulb system 20 according to the present invention. It should be noted that the top circuit board 32 may be electrically connected to at least one but may be all four of the circuit boards 30 to which it is in contact with. This may allow for the proper voltage to be passed through to the top or fifth circuit board 32 thus allowing for the LED 24 to function properly from that position. It should be noted that the thickness of all of the circuit boards 28, 30, 32 generally may be the same, however any known thickness may be used for the circuit boards 28, 30, 32 depending on the design and environment in which the LED light bulb system 20 may be used. It should be noted that generally a twelve volt light bulb system 20 has been described herein, however the light bulb system 20 may be used in any other lower voltage or higher voltage environment depending on the design of the LED and power electronic systems. It should be noted that all of the circuit boards generally are made of a silicone material, however any other known material, such as any known plastic, metal, ceramic, composite, or natural material may be used to create the circuit boards and the necessary circuitry thereon.

The LED light bulb system 120 may also include an alternate embodiment, which generally operates and has the same components as that described above. Like numerals indicate like parts. In this alternate embodiment of the LED light bulb system 120 a RC current limiting resistor 150 may be arranged or secured on a surface of at least one of the plurality of circuit boards 130 of the light bulb system 120. In one contemplated embodiment the current limiting resistor 150 is arranged on an inside surface of the circuit board 130 which is the side opposite the outer side having an LED 124 thereon. The alternate embodiment LED light bulb system 120 may also have arranged on or secured to another of the plurality of circuit boards 130 a common cathode diode 152 which acts as a positive pole for the LED light bulb system 120 and a common anode diode 154 which acts as a negative pole for the LED light bulb system 120. In one contemplated embodiment the common cathode diode 152 and common anode diode 154 are arranged on an inside surface of the circuit board 130 which is the side opposite the outer side having an LED 124 thereon. It should be noted that any known common cathode diode 152, common anode diode 154 or RC current limiting resistor 150 may be used depending on the design requirements and environment in which the LED light bulb system 120 may be used. The common cathode diode 152 may be electrically connected to the current limiting resistor 150 by any known means such as but not limited to a wire, solder, etc. The common anode diode 154 may be electrically connected to the support circuit board 128 by any known means. As described above, all of the plurality of circuit boards 130 of the alternate embodiment of the LED light bulb system 120 may be in electrical communication with the metal contactors 126 of the LED light bulb system 120. It should be noted that as described above, metal contactors 126 may be made of any known metal, however in one contemplated embodiment a conductive copper is used and may allow for conduction to the circuit boards 130 from the metal contactors 126. The alternate embodiment may also use the same type of LED's 124 as the light source as described above, such as but not limited to a 5050SMD, which is in LED 5050 light source. The use of the common cathode diode 152 and common anode diode 154 along with the RC current limiting resistor 150 in the alternate embodiment may allow for the LED light bulb system 120 to be plugged into a socket in which the light bulb system 120 is arranged in either direction, thus making for an easier installation process for the person installing the light bulb 120 into the socket. Thus, the base 122 may be put into the socket in either or any direction which creates an easier to use part and more efficient part, thus increasing the efficiencies of the manufacturing process. It should be noted that a multitude of common cathode diodes, common anode diodes, and RC current limiting resistors may be used other than that as described above and may be arranged on other circuit board surfaces of the present invention including but not limited to any of the plurality of circuit boards 130 or the support circuit board 128.

FIGS. 14 through 22 show an alternate embodiment of an LED light bulb system 200 according to the present invention. In the alternate embodiment shown in these figures, the light bulb 200 is what is commonly referred to as a T5 wedge type light bulb for use in numerous lighting applications. Generally, the T5 bulb is a smaller bulb than the T10 wedge style bulb described above. The T5 LED light bulb system 200 may convert standard T5 bulbs using filaments and other electronic technology into an LED based light bulb system 200. This may allow for more efficient lighting and longer life for the light bulbs in the lighting application. In one contemplated embodiment, the T5 bulb is used in automotive applications and vehicles throughout a vehicle system. Like numerals indicate like parts. As shown in the figures, the alternate embodiment of the LED light bulb system 200 generally includes a base 201, which is used to interact with and be located within a socket or receptacle of a vehicle or other component. This may allow for the LED light bulb system 200 to be arranged within a vehicle or other component via the base 201. The base 201 of the LED light bulb system 200 is generally made of a plastic material. However, it should be noted that any other material may be used for the base 201 and any other component of the LED light bulb system 200 including but not limited to any known metal, ceramic, composite, plastic, natural material, etc. Generally, the base 201 may be a twist in socket base that has at least one locking ramp 203 and locking shoulder 205 arranged thereon. In one contemplated embodiment, a first and second locking ramp 203 may be arranged 180° from one another on a collar 207 of the base 201. The ramps 203 and locking shoulders 205 may allow for the LED light bulb system 200 to mate with and interact with a receptacle, socket or component arranged on a circuit board, or any other known device of a vehicle or other component. The receptacle or socket into which the base 201 may be arranged generally has complimentary locking surfaces or ramps to interact with the locking shoulders 205 and ramps 203 located on the collar 207 of the base 201 of the present invention. Generally, the LED light bulb system 200 of the present invention may be locked into position by inserting into a socket and twisting in a predetermined direction to engage and lock the locking shoulders 205 and ramps 203 to a reciprocal surface in the socket. However, it is also contemplated to use a push and lock system that may not need twisting of the base 201 once it is arranged within a socket. It should be noted that the rotation of the base 201 in the socket may be in either a clockwise or counter clockwise direction depending on the design of the LED light bulb system 200. The collar 207 of the base 201 of the present invention generally may have a first and second notch 209 arranged 180° from one another and approximately 90° from the locking shoulders 205 of the collar 207. The notch 209 may allow for receiving, placing or arrangement therein of a contactor 211. One end of the base 201 generally may have a predetermined shaped knob that may be used for gripping and rotating the base 201 into its appropriate receptacle or socket. In one contemplated embodiment, the knob 213 generally has six sides to allow for easy gripping by a person inserting the bulb into the appropriate socket. The base 201 may also include a generally rectangular shaped groove 215 along a center line or mid point thereof. At least one contactor 211 is arranged within this groove 215. The base 201 of the present invention may also include a plurality of locking slots arranged near the end of the corners of the groove of the socket base 201. The locking slots generally may have a square or rectangular like shape and extend vertically down into the socket base. These locking slots help to secure the contactor 211 within the groove 215 of the base 201. The base 201 may also include on an end opposite of the knob having a generally circumferential lip 217. The circumferential lip 217 generally is divided into two generally half circle arcs with the groove 215 arranged therebetween. The circumferential lip 217 forms a circumferential notch for the end of the base 201. The circumferential lip 217 may also include a tab 219 extending radially inward therefrom. Generally, in one contemplated embodiment, two tabs are arranged 180° from one another on each half of the circumferential lip 217. The tabs 219 may be used to interact with a support circuit board 221 to secure and align the support circuit board 221 to the base 201. It should be noted that it is contemplated to have no tabs or more than two tabs as described above arranged from the lip of the base 201. It should further be noted that the locking ramps and shoulders of the base 201 may also be capable of flexing in a predetermined direction to ensure proper locking of the LED light bulb system 200 into the receiving socket or receptacle. It should be noted that the base 201 may also include a first and second arm 227 extending from an outside surface thereof arranged 180° from one another and generally aligned with the groove 215 along the mid line of the base 201.

The alternate embodiment of the LED light bulb system 200 may also include a contactor 211 generally made of a metal material. The contactor 211 may be made of any known electrically conductive material, such as any known ceramic, composite, plastic or natural material that is electrically conductive and capable of passing electricity therethrough. In one contemplated embodiment, the contactor 211 may be made of a conductive copper which may be in electrical communication and allow for conduction to occur to the circuit boards arranged on the LED light bulb system 200. Generally, in the LED light bulb system 200 of the alternate embodiment of the present invention a first and second contactor 211 may be arranged within the groove of the base 201. The contactor 211 generally has a body and a predetermined number of legs extending from the body of the contactor 211. The contactor 211 may also have an arm extending at a generally 90° right angle from the body at a predetermined point thereof. The arm of the contactor 211 may engage with an end portion of the groove 215 of the base 201. It should be noted that on a top surface of each of the arms of the contactor 211 may have a raised bump or mound 223 that may ensure proper contact between the electrical power source and the LED light bulb system 200. One of the legs of the contactor 211 may extend out at a generally right angle from a bottom portion of the body of the contactor 211 and then extend and turn at another generally 90° angle towards the top of the contactor 211 until an end thereof is in a similar plane as the end of the other two legs which extend directly from the body of the contactor 211. Thus, the legs of the contactor 211 may all be parallel to one another in a predetermined pattern when viewed from above. The ends of the legs of the contactors 211 may engage and contact the support circuit board 221 arranged in the base 201 of the present invention. This may allow for power to be passed from the arms of the contactors 211 directly to the support circuit board 221 and then onto the other circuit boards and LED lights. It should be noted that it is also contemplated to create one contactor 211 which only has a U-shape instead of two separate contactors 211 as shown in the present invention. It is contemplated to use a press fit to secure the contactors 211 within the locking slots and groove of the base 201. However, any other connecting means either mechanical or chemical may also be used including but not limited to gluing, welding, soldering, or any other mechanism for holding the contactor 211 within the base 201.

The LED light bulb system 200 of the alternate embodiment also may include a support circuit board 221 which generally has a disc like shape. The support circuit board 221 may include a first and second notch 241 arranged 180° from one another in an outside surface thereof. In one contemplated embodiment the notch 241 may be in a generally semi circular shape such that it interacts and interengages with the semi circular shaped tabs 219 arranged on the lip 217 of the base 201. This may ensure that the support circuit board 221 is rotatably fixed, aligned and secured within the base 201 at a predetermined position without the possibility of being vibrated loose. It should be noted that any known securing technique may be used to secure the support circuit board to the base 201, such as any known chemical or mechanical fastening technique, such as gluing, press fit, soldering, snap lock, etc. Proper placement of the support circuit board 221 within the base 201 ensures electrical contact is made between the contactor 211 and electrical circuit of the support circuit board 221. This may allow power to flow through the support circuit board 221 to additional circuit boards attached thereto. It should be noted that the support circuit board 221 may have any known shape other than the generally disc like shape depending on the design and environment in which the LED light bulb system 200 may be used. The support circuit board 221 may have a predetermined diameter and thickness that generally mimics and is about the same as the lip 217 of the base 201. The support circuit board 221 may be made of any known material, such as silicone or any other known material used for circuit boards. The support circuit board 221 may also include at least one orifice arranged through a surface thereof. In one contemplated embodiment the orifice generally may be used to secure a circuit board thereto that may be arranged on a top surface of the support circuit board 221. This may allow for a more robust connection between the circuit boards having the LED's arranged thereon and the support circuit board 221 of the LED light bulb system 200. However, it is also contemplated to use soldering or any other fastening technique to secure the other circuit boards to the support circuit board 221 of the present invention.

The LED light bulb system 200 of the alternate embodiment may also include a first circuit board 225 connected and arranged on a top surface of the support circuit board 221 according to the present invention. Generally, in one contemplated embodiment, the first circuit board 225 includes a circuit board having a generally rectangular shape. However, it should be noted that any other shape may be used for the first circuit board 225 according to the present invention. The first circuit board 225 generally is arranged and connected at one end to the top surface or through the top surface of the support circuit board 221 depending on the design requirements. The first circuit board 225 generally is arranged on a top surface of the support circuit board 221 such that the first circuit board 225 is perpendicular to the support circuit board 221. The first circuit board 225 is aligned such that it follows along in generally the same plane as the groove 215 formed along a mid line of the base 201. The first circuit board 225 generally having a rectangular shape has one of its shorter ends secured to the support circuit board 225 via any known mechanical or chemical fastening technique. The width, shape and design of the first circuit board 225 may be different than that of a rectangle as shown in the drawings. The first circuit board 225 may include a common anode diode 229 or negative pole on one surface thereof and a common cathode diode 231 or positive pole on another surface thereof. In one contemplated embodiment the common anode diode 229 is arranged on one side of the first circuit board 225 and the common cathode diode 231 is arranged on the opposite side of the first circuit board 225. Both the common anode diode 229 and common cathode diode 231 are electrically connected to the circuit creating the power necessary to energize the LED light sources arranged on the circuit boards. At least one RC current limiting resistor 233 is also arranged on the first circuit board 225 and electrically connected with the electric circuit of the LED light bulb system 200 according to the present invention. In one contemplated embodiment, the current limiting resistor 233 is arranged on each side of the first circuit board 225 according to the present invention. It should further be noted that at least one LED light source 235 may be arranged on the first circuit board 225. In one contemplated embodiment, an LED light source 235 is arranged on each side of the first circuit board 225 to provide proper light emission for the T5 bulb system. In one contemplated embodiment, the LED light source 235 is a 3014 SMD LED light source and is arranged and secured facing in an outward direction on each side of the first circuit board 225 such that it is able to shine light in most all directions from the light bulb system 200. The LED SMD 235 may have any known shape, such as but not limited to rectangular, as shown in the drawings, square, circular, triangular, any other known or random shape, etc. It should further be noted that it is also contemplated to create an LED light bulb system 200 according to the present invention that does not include the common cathode diode, common anode diode, or the current limiting resistors. Such a LED light bulb system that does not include those components would have to be assured to be properly aligned and placed into the socket or receptacle to allow for proper operating of the LED light sources.

It should also be noted that it is contemplated in the alternate embodiment of the LED light system 200 to have a second circuit board 237 secured to a top end of the first circuit board 225. This securing of the second circuit board 237 to the first circuit board 225 may allow for electrical communication between the first and second circuit boards and the support circuit board, thus allowing for the LED light bulb system 200 to operate properly. The connection between the second circuit board 237 and the first circuit board 225 may be any known mechanical or chemical fastening technique, such as but not limited to tabs used to secure the boards to one another, or solder being used to secure the boards to one another and any other known chemical or mechanical fastening technique. In one contemplated embodiment, the second circuit board 237 may generally have a circular disc like shape that mimics that of the support circuit board 221. However, any other shape may be used for the second circuit board 237 depending on the design requirements and environment in which the LED light bulb system 200 may be used. Generally, the second circuit board 237 may include at least one LED light source 235 on a top surface thereof that may allow for light to be shined in a vertical direction away from the base 201. This may provide light to be emitted in all directions from the LED light bulb system 200. It should be noted that any other shape circuit board may also be used for the second circuit board 237 according to the present invention. In one contemplated embodiment the second circuit board 237 may have multiple SMD LED 235 arranged in a predetermined pattern on its outer surface such that there are three LED light sources 235 arranged in a generally triangular pattern when viewed from above on the top surface of the second circuit board 237. However, any number of SMD LED 235 may be secured to the top surface of the second circuit board 237 by soldering or any other known methodology and electrically connected to the electric circuit of the LED light bulb system 200. It should also be known that the thickness of all of the circuit boards generally may be the same, however any known thickness may be used for the circuit boards depending on the design and environment in which the LED light bulb system 200 may be used. It should further be noted that generally the circuit boards are designed the same as those embodiments described above and the methodology of connecting and fastening the circuit boards to one another and to the base generally may be the same as the embodiments described above.

The present invention has been described in an illustrative manner. It is to be understood that the terminology, which has been used, is intended to be in the nature of words of description rather than that of limitation.

Many modifications and variations of the present invention are possible in light of the above teachings. Therefore, within the scope of the appended claims, the present invention may be practiced otherwise than as specifically described.

What is claimed is:

1. A light bulb, said bulb comprising:

a base, said base having at least one ramp on a surface thereof;

a contactor arranged in said base;

a support circuit board secured to said base;

a first circuit board connected to said support circuit board on one end thereof, said first circuit board in a same plane as said contactor; and a second circuit board connected to said first circuit board, said second circuit board is parallel to said support circuit board.

2. A light bulb, said bulb comprising:

a base, said base having a groove along a centerline thereof;

a contactor arranged in said base;

a support circuit board secured to said base;

a first circuit board connected to said support circuit board on one end thereof, said first circuit board in a same plane as said contactor; and a second circuit board connected to said first circuit board, said second circuit board is parallel to said support circuit board.

3. A light bulb, said bulb comprising:

a base, said base having at least one tab extending radially inward from a top edge thereof;

a contactor arranged in said base;

a support circuit board secured to said base;

a first circuit board connected to said support circuit board on one end thereof, said first circuit board in a same plane as said contactor; and a second circuit board connected to said first circuit board, said second circuit board is parallel to said support circuit board.

4. The bulb of claim 1 wherein said base having at least one locking member extending from a surface thereof.

5. The bulb of claim 1 wherein said contactor is made of copper.

6. The bulb of claim 1 wherein said contactor having a bump or raised surface.

7. The bulb of claim 1 wherein said contactor is electrically connected to said support circuit board.

8. The bulb of claim 1 wherein said support circuit board has a generally disc like shape.

9. The bulb of claim 1 wherein said support circuit board is secured in a circumferential notch of said base.

10. The bulb of claim 1 wherein said first circuit board having a generally rectangular shape.

11. The bulb of claim 1 wherein said first circuit board having at least one light emitting diode arranged on a surface thereof.

12. The bulb of claim 1 wherein said first circuit board having a current limiting resistor arranged on a surface thereof.

13. The bulb of claim 1 wherein said first circuit board having a common cathode diode and a common anode diode arranged thereon.

14. The bulb of claim 1 wherein said second circuit board having a generally disc like shape.

15. The bulb of claim 1 wherein said second circuit board having at least one light emitting diode arranged on a surface thereof.

16. A light emitting diode system for use in lighting applications, said system comprising:

a base;

an electrically conductive contactor secured to said base;

a support circuit board secured to said base and electrically connected to said contactor;

a first circuit board arranged on a surface of said support circuit board, said first circuit board is perpendicular to said support circuit board, said first circuit board having a current limiting resistor, said first circuit board having a common cathode diode and a common anode diode, said common cathode diode, said common anode diode and said current limiting resistor allow for said base to be plugged into a socket in either direction;

a second circuit board connected to said first circuit board, said second circuit board is parallel to said support circuit board; and a light emitting diode secured to said first circuit board and said second circuit board.

* * * * *